US008360831B2

(12) United States Patent
Lien

(10) Patent No.: US 8,360,831 B2
(45) Date of Patent: Jan. 29, 2013

(54) SANDING TOOL

(76) Inventor: Chin-Hsiung Lien, El Monte, CA (US)

( * ) Notice: Subject to any disclaimer, the term of this patent is extended or adjusted under 35 U.S.C. 154(b) by 327 days.

(21) Appl. No.: 12/800,223

(22) Filed: May 10, 2010

(65) Prior Publication Data

US 2011/0275294 A1 Nov. 10, 2011

(51) Int. Cl.
*B24B 19/00* (2006.01)

(52) U.S. Cl. ..... 451/540; D8/90

(58) Field of Classification Search ..... 451/523, 451/527, 524, 525; 15/424–434, 229.11, 15/229.13, 104.04, 244.4, 105, 118
See application file for complete search history.

(56) References Cited

U.S. PATENT DOCUMENTS 2,214,515 A * 9/1940 Vanderveer ..... 451/523
3,998,012 A * 12/1976 Ness ..... 451/523
D271,817 S * 12/1983 Collin ..... D32/40
4,757,571 A * 7/1988 Young ..... 15/167.3
5,419,087 A * 5/1995 Haddy ..... 451/344
6,997,786 B2 * 2/2006 Tchernov ..... 451/53
2007/0099551 A1 * 5/2007 Walsh ..... 451/523
2008/0207099 A1 * 8/2008 Brown ..... 451/524
2009/0264058 A1 * 10/2009 Brogden ..... 451/525
2011/0139168 A1 * 6/2011 Burden et al. ..... 132/76.4

* cited by examiner

*Primary Examiner* — Lee D Wilson
*Assistant Examiner* — Marc Carlson
(74) *Attorney, Agent, or Firm* — Raymond Y. Chan; David and Raymond Patent Firm

(57) ABSTRACT

A sanding tool includes a hand-held tool body, and a sanding arrangement which has a plurality of elongated sanding grooves spacedly provided at an outer circumferential side of the tool body and longitudinally extended from the first side of the tool body to the second side thereof. Each of the sanding grooves has two open ends formed at the first and second sides of the tool body respectively, and a concave-sanding surface defining two arc-sanding faces therealong, such that when the tool body is held for contacting a rough portion of the workpiece with one of the arc-sanding faces, the tool body is adapted to impart reciprocating movement for sanding the rough portion of the workpiece along the respective sanding groove.

16 Claims, 11 Drawing Sheets

SANDING TOOL

BACKGROUND OF THE PRESENT INVENTION

1. Field of Invention

The present invention relates to a sanding tool, and more particularly to a multifunctional hand manipulated sanding tool for smoothing or sanding a workpiece, wherein a rough edge of the workpiece is able to be guided and abraded via a sanding groove of the sanding tool, so that an abrading force thereof is able to evenly and simply applied on the rough edge of the workpiece.

2. Description of Related Arts

In order to finish an outer or inner surface of the workpiece, an auxiliary tool or grinding machine is provided for smoothing the surface of the workpiece. Those tools may also be used for partially sanding the surface of the workpiece depended on the application thereof. The hand sanding or abrading tools are commonly provided for manually finishing the surface of the workpiece, so as to increase the quality thereof. Due to the flexibility and simplicity of operating the hand sanding or abrading tool, such as the sandpaper or traditional files having variety of cuts or tooth configurations, it is widely applied for finishing or rubbing the workpiece.

Although those tools are suitable for a number of applications, the existing hand tools for finishing the surface of workpiece are still suffering from some disadvantages. The workpiece may have a plurality of rough edges, so that the sandpaper or traditional files may not be able to easily and evenly apply an abrading force thereon for finishing and smoothing the surface of the rough edge of the workpiece. For instance, a rectangular wooden workpiece may have twelve sharpened right angled edges. The sandpaper may be chosen for smoothing the flat surface of the rectangular workpiece. However, the sandpaper is hard to evenly apply the abrading or sanding force on each of the sharpened edges having tiny contacting surface, so that the edges turn out easily deformed after applying the sanding force thereon by the hand of the user.

Another common disadvantage of the hand-powered abrading tools is that the user may have to have variety of types and shapes of abrading tools for applying the abrading or sanding force on different configurations of workpiece or for a number of applications.

SUMMARY OF THE PRESENT INVENTION

The invention is advantageous in that it provides a sanding tool, which is able to evenly abrade the workpiece at a corner edge, rough surface, and/or tube end configuration.

Another advantage of the invention is to provide a sanding tool, wherein the sanding grooves are able to guide the edge of the workpiece to reciporcatedly move along the sanding groove, so as to evenly apply the abrading force on the edge surface of the workpiece.

Another advantage of the invention is to provide a sanding tool, which has a slanted sanding surface for abrading a relatively larger surface of the workpiece.

Another advantage of the invention is to provide a sanding tool, wherein the geometric shape of the tool body enhances the ergonomic feature thereof for maximum comfort, efficiency, and ease of use, such that the sanding tool is able to be held and manipulated by a user to efficiently apply the abrading force on the surface of workpiece.

Another advantage of the invention is to provide a sanding tool, which combines multi-functions in one single sanding tool, so that the sanding tool is able to be used for abrading variety of surfaces or shapes of the workpiece, so as to enhance the convenience of using the sanding tool.

Another advantage of the invention is to provide a sanding tool, which is able to be applied for abrading workpiece made of iron, wood, rubber, or the like.

Another advantage of the invention is to provide a sanding tool, which is able to abrade the outer and/or inner peripheral edges of the workpiece with various tubular shapes.

Another advantage of the invention is to provide a sanding tool, wherein the collection cavity formed at the sanding planarity is able to temporarily collect the residual material being removed from the surface of workpiece while abrading the workpiece, so as to prevent the surfaces of the tool body being clogged to decrease the friction thereof. Thus, the sanding tool is able to efficiently abrade the surface of workpiece.

Another advantage for the invention is to provide a sanding tool, wherein no expensive or complicated structure is required to employ in the present invention in order to achieve the above mentioned objects. Therefore, the present invention successfully provides an economic and efficient solution for effectively sanding the workpiece at different orientations and/or different sanding degrees.

Additional advantages and features of the invention will become apparent from the description which follows, and may be realized by means of the instrumentalities and combinations particular point out in the appended claims.

According to the present invention, the foregoing and other objects and advantages are attained by providing a sanding tool, which comprises:

an elongated hand-held tool body having a first side, an opposed second side, and an outer circumferential side extended from the first side to the second side; and a sanding arrangement which contains a plurality of elongated sanding grooves spacedly provided at the outer circumferential side of the tool body and longitudinally extended from the first side to the second side, wherein each of the sanding grooves has two open ends formed at the first and second sides of the tool body respectively and a concave-sanding surface defining two arc-sanding faces therealong, such that when the tool body is held for contacting a rough portion of the workpiece with one of the arc-sanding faces, the tool body is adapted to impart reciprocating movement for sanding the rough portion of the workpiece along the respective sanding groove.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
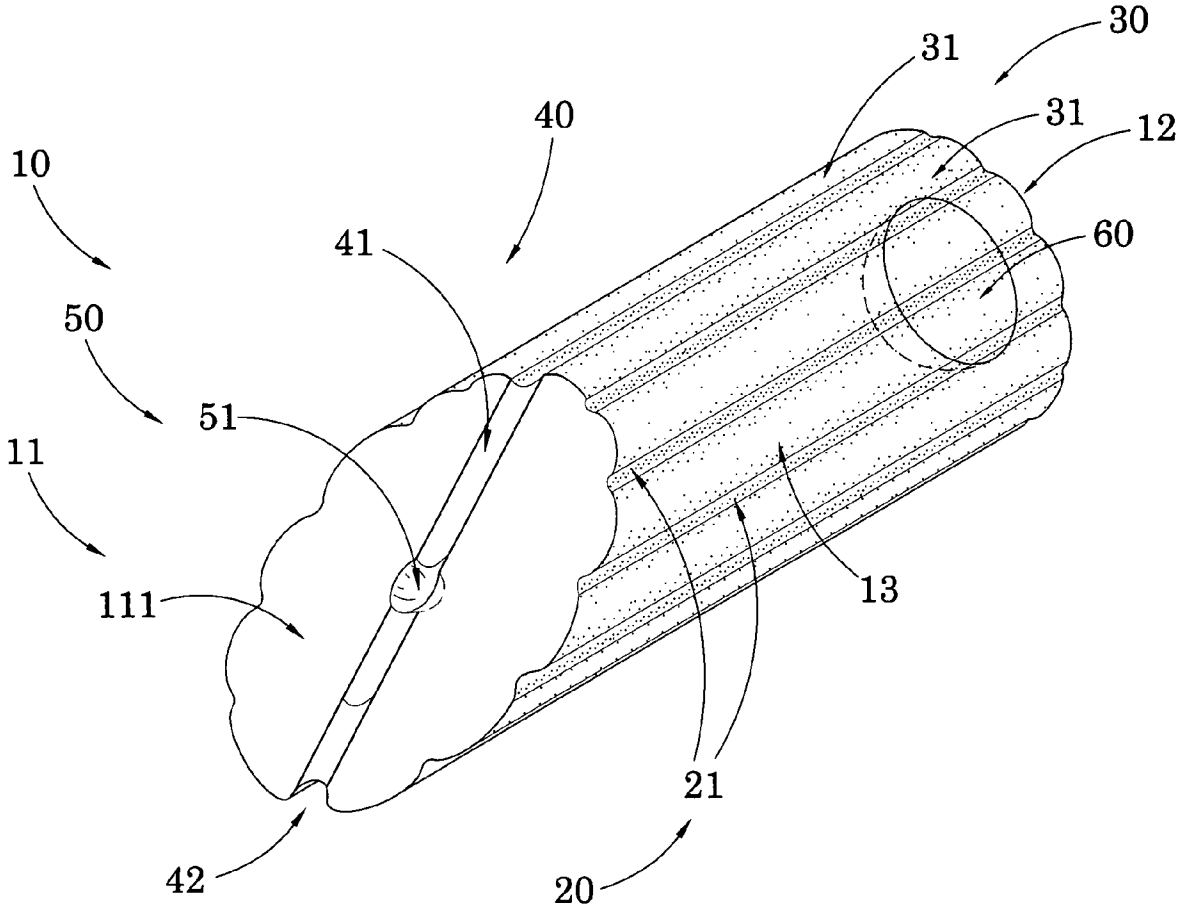
FIG. 1 is a front perspective view of a sanding tool according to a preferred embodiment of the present invention.

Referring to FIGS. 1 to 4 of the drawings, a sanding tool for a workpiece 90 according to a preferred embodiment of the present invention is illustrated, wherein the sanding tool comprises a tool body 10 and a sanding arrangement 20.

According to the preferred embodiment, the tool body 10, which has an elongated hand-held tool body structure adapted for a user to hold by hand tightly, has a first side 11, an opposed second side 12, and an outer circumferential side 13 extended from the first side 11 to the second side 12. Preferably, the tool body 10 has a circular cross section.

The sanding arrangement has a plurality of elongated sanding grooves 20 spacedly provided at the outer circumferential side 13 of the tool body 10 and longitudinally extended from the first side 11 to the second side 12. Each of the sanding grooves 20, which is an elongated groove, has two open ends formed at the first and second sides 11, 12 of the tool body 10 respectively such that one of the open ends of each sanding groove 20 is formed at the peripheral edge of the first side 11 of the tool body 10 while another opposed open end of the sanding groove 20 is formed at the peripheral edge of the second side 12 of the tool body 10.

Each of the sanding grooves 20 further has a concave-sanding surface 21 defining two arc-sanding faces 211 therealong, wherein the concave-sanding surface 21 is indented on the outer circumferential surface 13 of the tool body 10. In other words, the arc-sanding faces 211 are two side portions of the sanding groove 20 that the trough of the concave-sanding surface 21 is positioned between the two arc-sanding faces 211.

According to the preferred embodiment, when the tool body 10 is held by the user's hand for contacting the rough portion of the workpiece 90 with one of the arc-sanding faces 211, the tool body 10 is adapted to impart reciprocating movement for sanding the rough portion of the workpiece 90 along the respective sanding groove 20. It is worth mentioning that the two arc-sanding faces 211 are extended on the outer circumferential side 13 of the tool body 10 from the first side 11 to the second side 12.

Figure 5A:
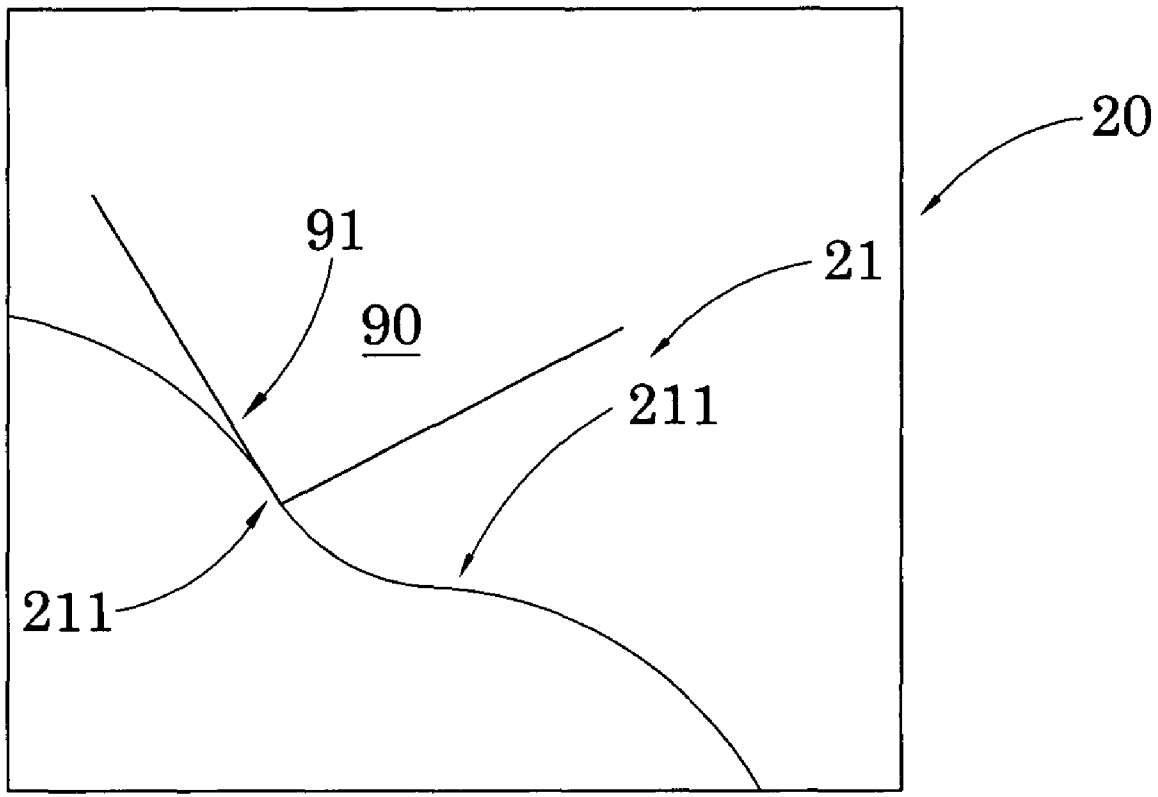
FIGS. 5A and 5B illustrates a corner edge or a shape edge of the workpiece being contacted with two arc-sanding faces of the sanding groove of the sanding tool according to the above preferred embodiment of the present invention.
Figure 5B:
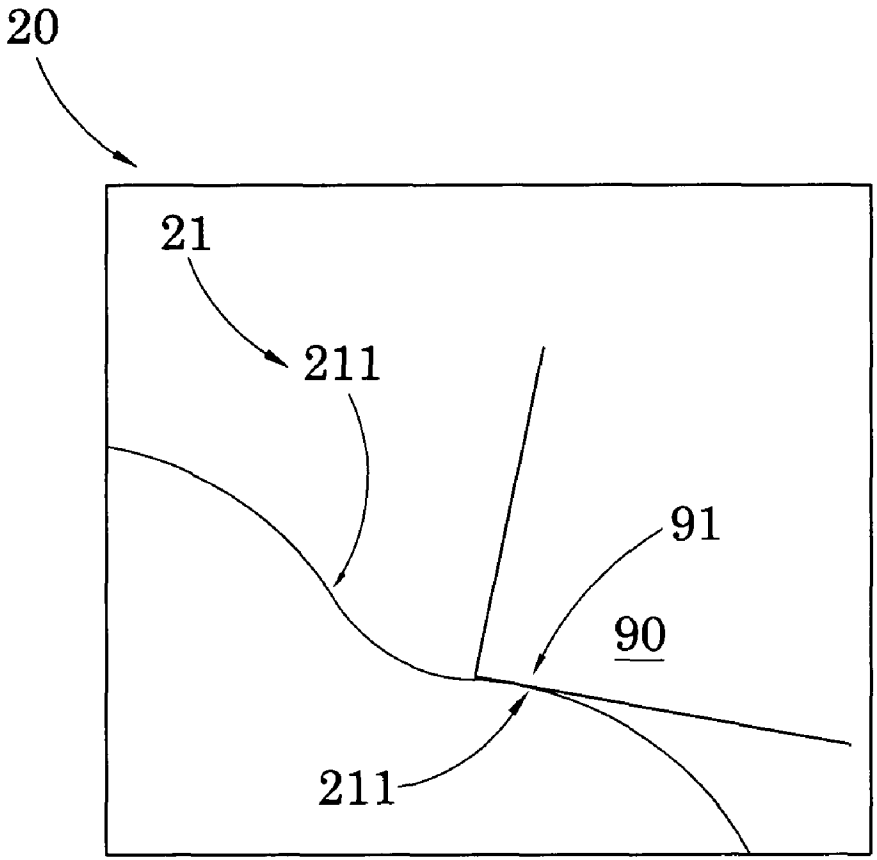

The sanding arrangement further comprises a plurality of convex sanding elements 30 alternating with the sanding grooves 20 and longitudinally extended from the first side 11 of the tool body 10 to the second side 12 thereof, wherein each of the convex sanding elements 30 has a convex-sanding surface 31 integrally extended between the concave-sanding surfaces 21 of the two neighboring sanding grooves 20, as shown in FIGS. 5A and 5B. Therefore, the outer circumferential side 13 of the tool body 10 forms a to wavy configuration that the trough is formed at each of the sanding grooves 20 while the crest is formed at each of the convex sanding elements 30.

As shown in FIGS. 5A and 5B, each of the sanding grooves 20 can guide a corner edge 91 or a sharp edge of the workpiece 90 to move along the sanding groove 20 reciprocatedly to sand each edge-side of the workpiece 90. In other words, when one side of the corner edge 91 of the workpiece 90 is aligned with the sanding groove 20 to contact with one of the arc-sanding faces 211, the workpiece 90 is able to be guided to reciprocatedly move along the sanding groove 20, so as to be abraded to form a relatively smoother surface of the workpiece 90. Therefore, each sanding groove 20 can sand two sides of the corner edge 91 of the workpiece 90 such that the corner edge 91 of the workpiece 90 can be sanded finely in details.

Accordingly, the sanding groove 20 not only provides two arc-sanding faces 211 to maximize the abrading area of the sanding tool, but also simply guides the corner edge 91 of the workpiece 90 moving therealong, so that an abrading force is able to evenly applied to the tiny contacting surface between the corner edge 91 of the workpiece 90 and the arc-sanding faces 211 of the sanding groove 20 through the sanding tool. In other words, the tool body 10 is able to simply hand manipulated to evenly apply the abrading force at the tiny non-even surface of the corner edge 91 of the workpiece 90.

As mentioned above, the corner edge 91 of the workpiece 90 could be any edges, corners, or thin parts of the workpiece 90. For examples, the sanding tool is able to evenly apply the abrading force at each of the three elongated edges of an elongated triangular column of the workpiece 90; or at each of the right-angle edges of a rectangular shaped workpiece 90, so that the edges of the workpiece 90 are able to be hand operated to reciprocatedly moved along the sanding groove 20 for being abraded, so as to smooth or rough the surface thereof. It is worth to mention that a smaller cylindrical shaped workpiece 90 may be able to contact with the two arc-sanding faces 211, so that an outer side surface of the cylindrical shaped workpiece 90 is able to be driven to reciprocatedly rotate along the concave-sanding surfaces 21 of the sanding groove 20 in a rotational direction, so as to abrade the surface of the cylindrical shaped workpiece 90.

Figure 2:
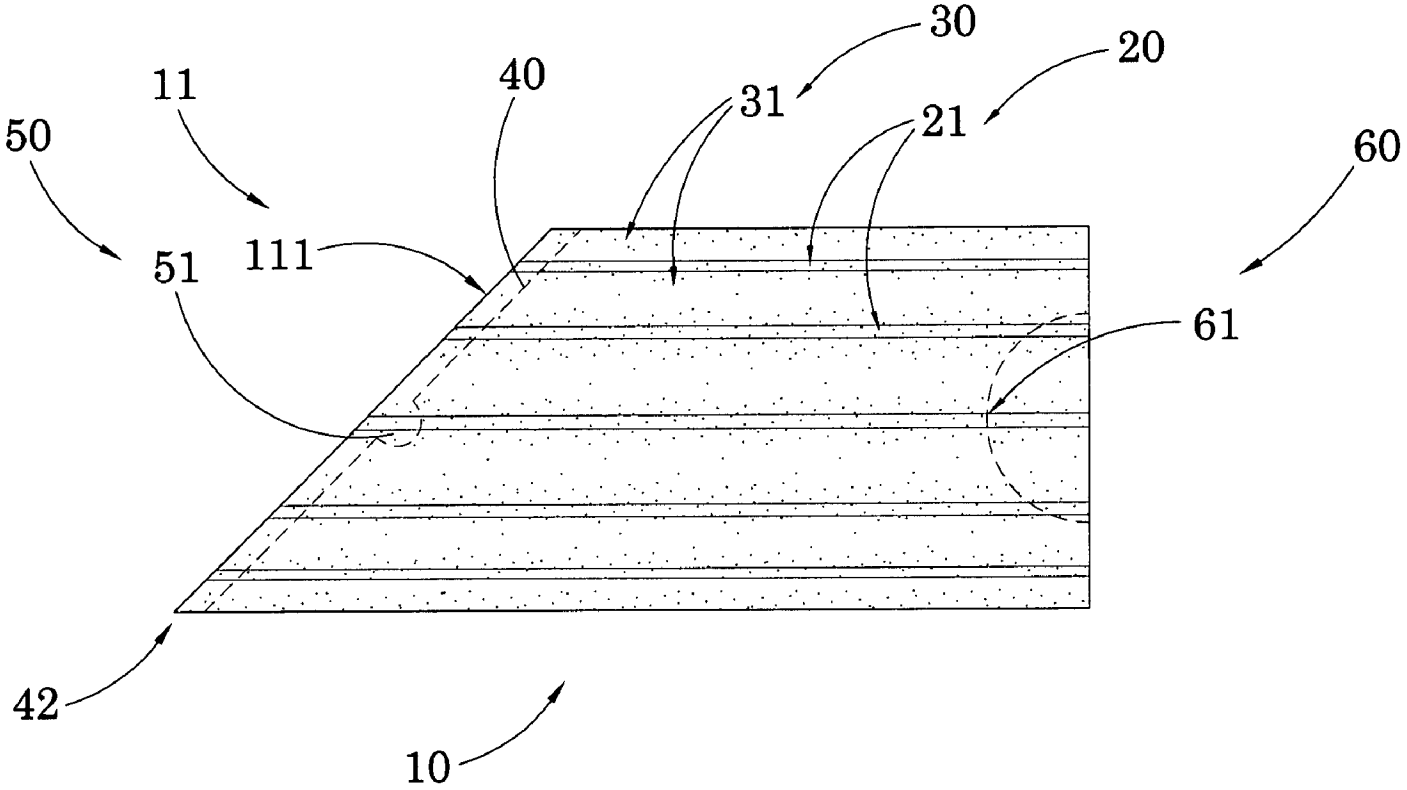
FIG. 2 is a side view of the sanding tool according to the above preferred embodiment of the present invention.
Figure 3:
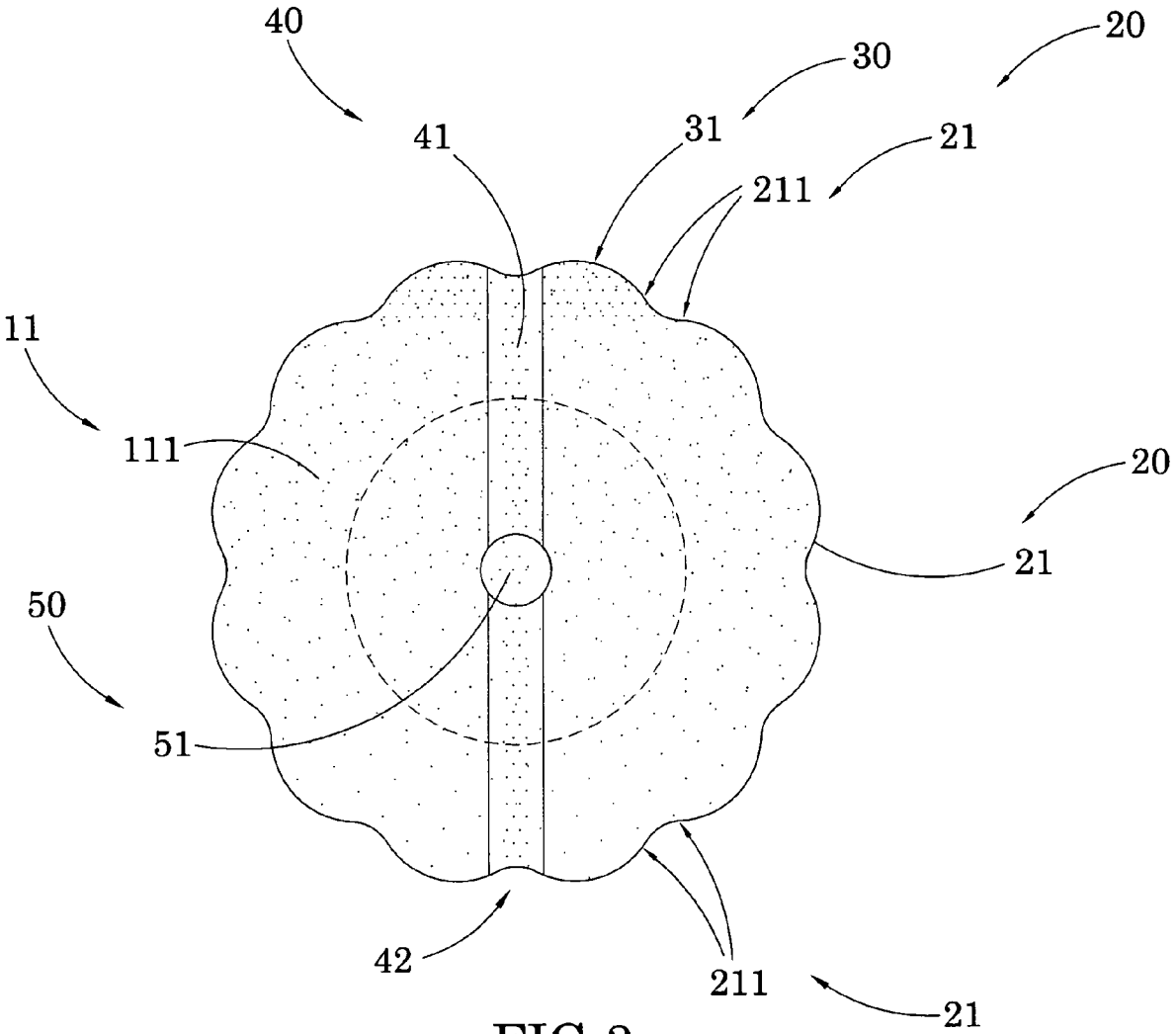
FIG. 3 is a sectional view of the sanding tool according to the above preferred embodiment of the present invention.
Figure 4:
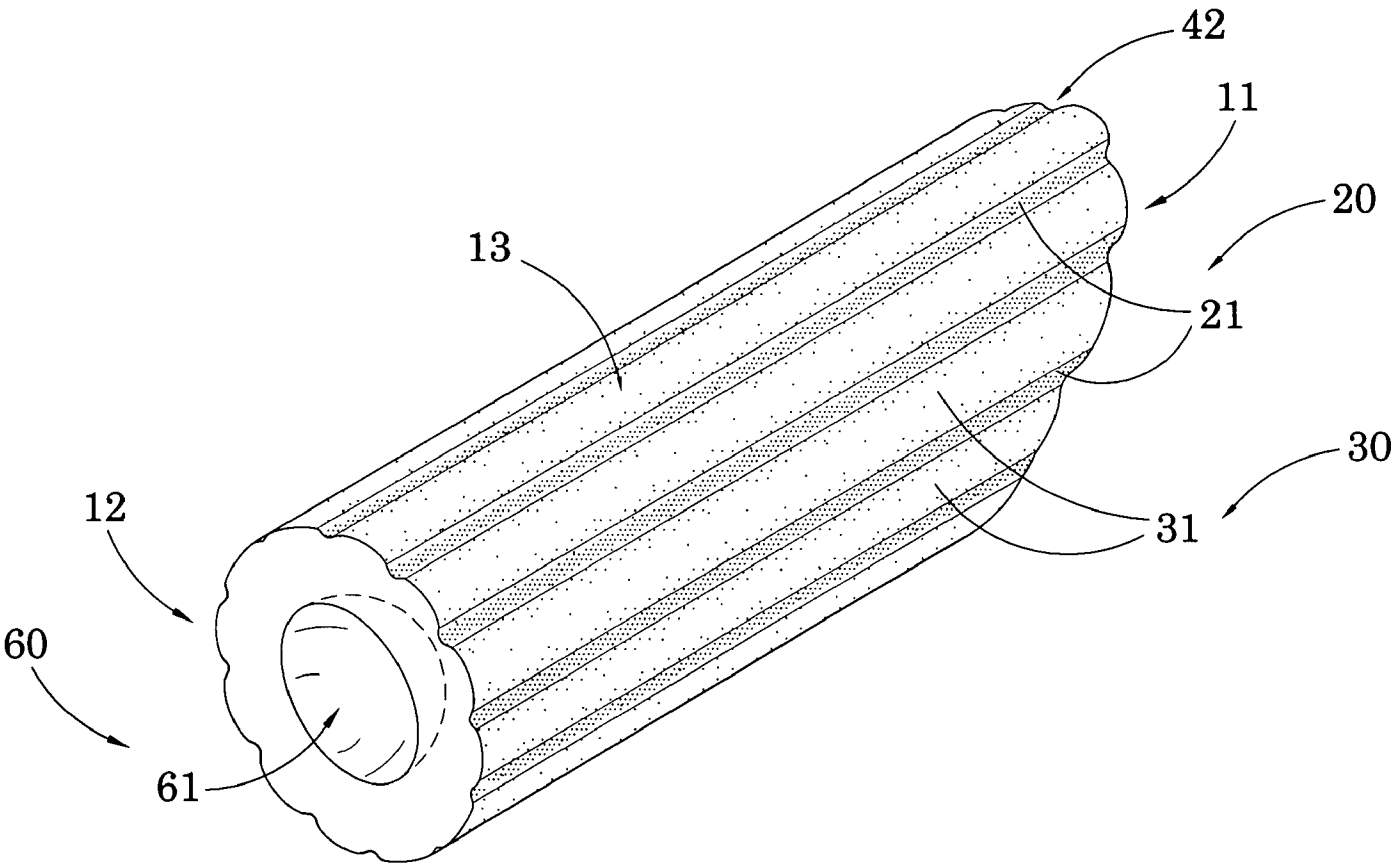
FIG. 4 is a rear perspective view of the sanding tool according to the above preferred embodiment of the present invention.

As shown in FIGS. 1 and 2, the first side 11 of the tool body 10 forms a slanted sanding surface 111 for enhancing a contact surface area to sand the workpiece 90 at the slanted sanding surface 111. Accordingly, the slanted sanding surface 111 has an elliptical shape. The slanted sanding surface 111 has a flat frictional surface thereon for abrading a relatively larger surface of the workpiece 90. It will be readily appreciated that the slanted sanding surface 111 is inclined at a predetermined inclined angle to maximize the abrading area of the slanted sanding surface 111, so that the workpiece 90 is able to simply abrade the rough edge via the sanding groove 20 and larger flat or non-flat surface of the workpiece 90 via the slanted sanding surface 111 in one tool structure of the sanding tool of the present invention.

As shown in FIG. 1, the sanding arrangement further contains a sanding passage 40 indently formed at the slanted sanding surface 111 along a major axis thereof to maximize the length of the sanding passage 40 on the slanted sanding surface 111, wherein the sanding passage 40 has a curved sanding surface 41 indented at the slanted sanding surface 111 of the tool body 10 and two opened ends alignedly extending with the opened ends of the two corresponding sanding grooves 20 at the circumferential side 13 of the tool body 10. Accordingly, the depth of the sanding passage 40 is larger than the depth of the sanding groove 20. Therefore, the sanding tool of the present invention provides different sizes of sanding grooves 20 and sanding passage 40 to fit different sizes of the edges of the workpieces 90.

As shown in FIG. 1, the open end of the sanding passage 40 is aligned with the opened end of the corresponding sanding grooves 20 at the tapered edge of the first side 11 of the tool body 10 to form a tapered sanding notch 42. It is appreciated that the tapered sanding notch 42 having an approximately parabolic shaped indentation is able to flexibly reach other smaller sharpened edges of the workpiece 90, so as to combine another function in one sanding tool of the present invention. In particularly, the tapered sanding notch 42 can precisely reach the inner and outer circumferential edges of the tubular end 93 of the workpiece 90, such as inner peripheral edges of an opening of a tube 94, as shown in FIG. 6 and FIG. 7C, such that the tapered sanding notch 42 can abrade at the inner and outer circumferential edges of the tubular end 93 of the workpiece 90.

Figure 7A:
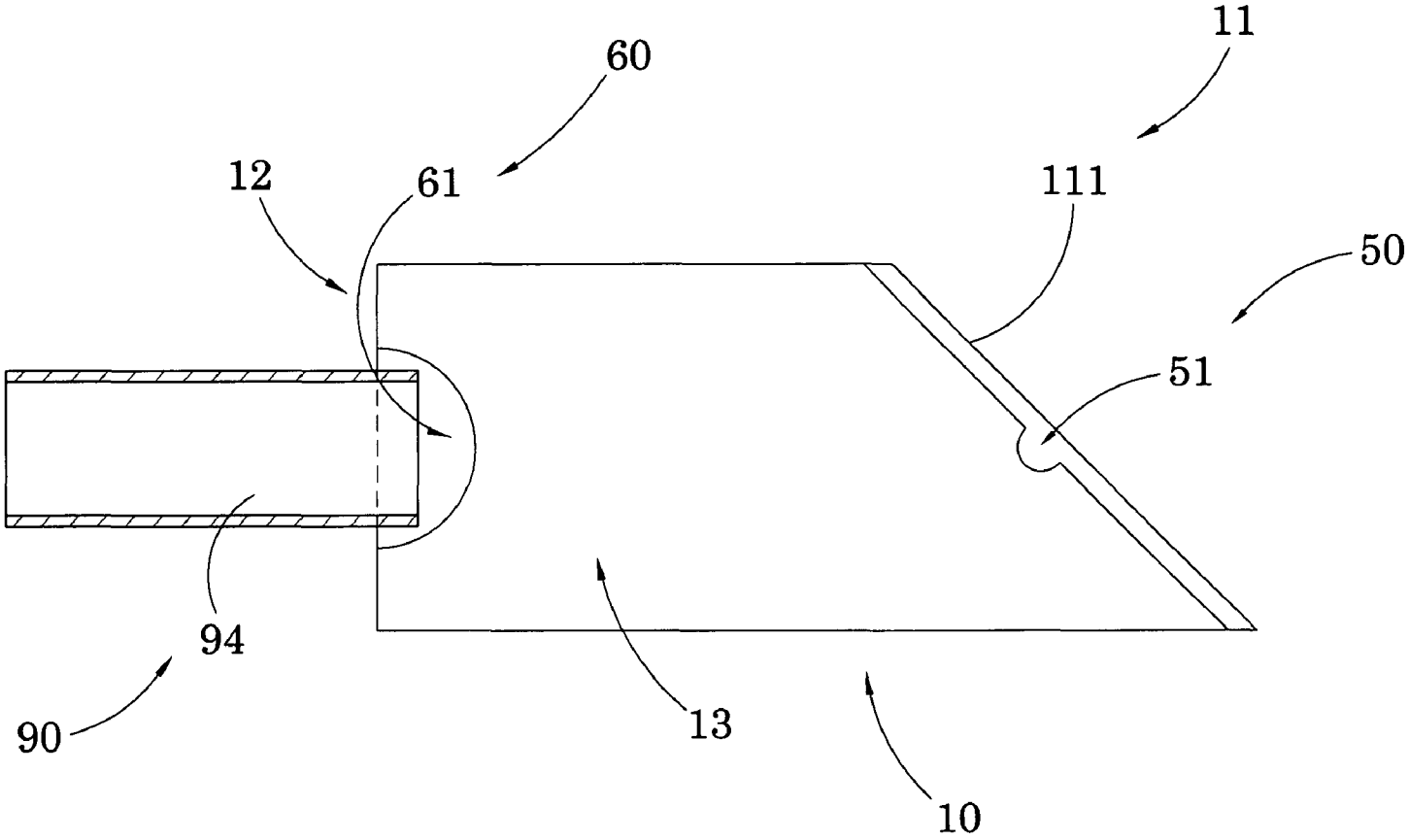
FIGS. 7A to 7D further illustrate different sanding applications of the workpiece according to the above preferred embodiment of the present invention.
Figure 7B:
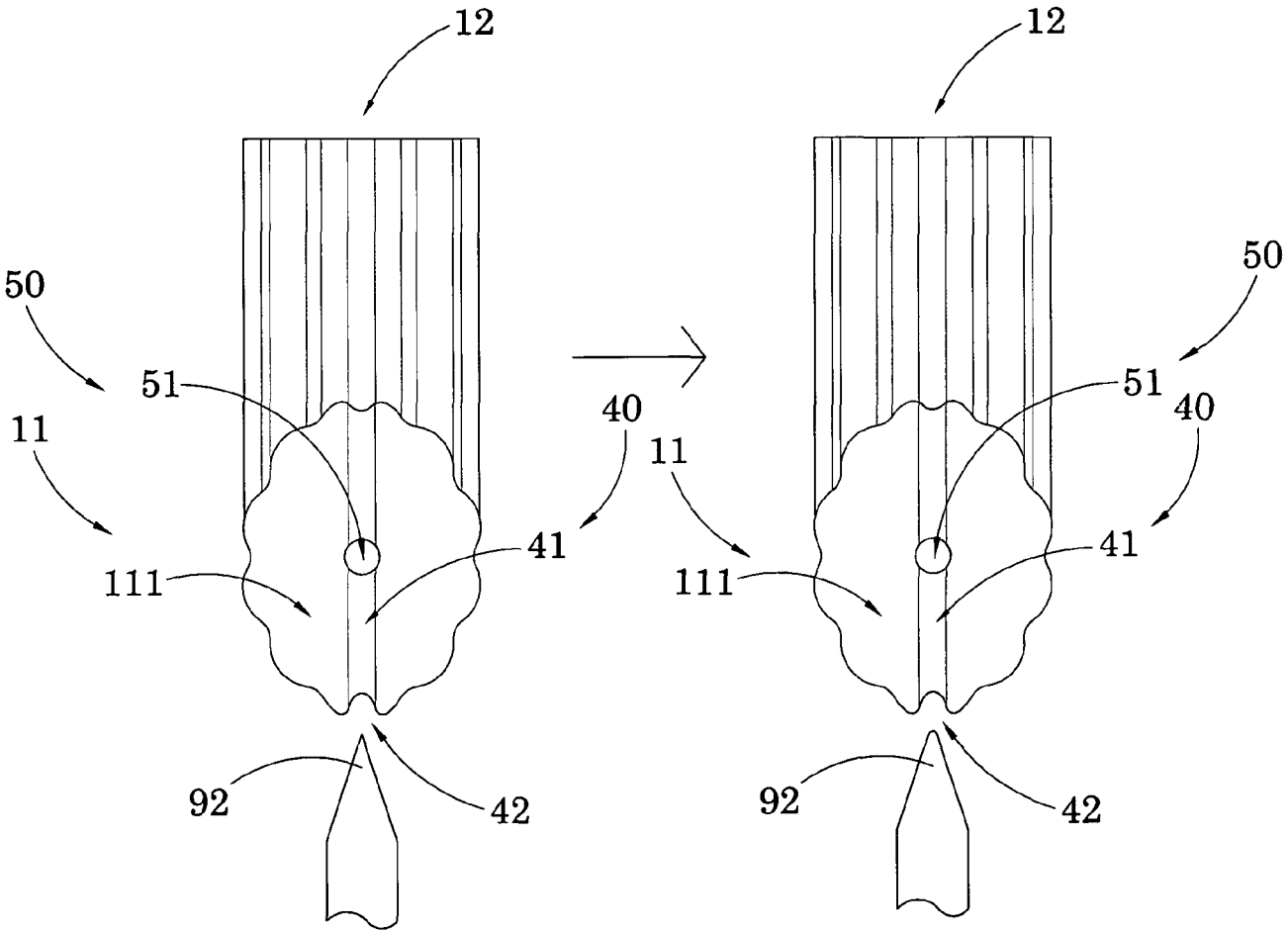
Figure 7C:
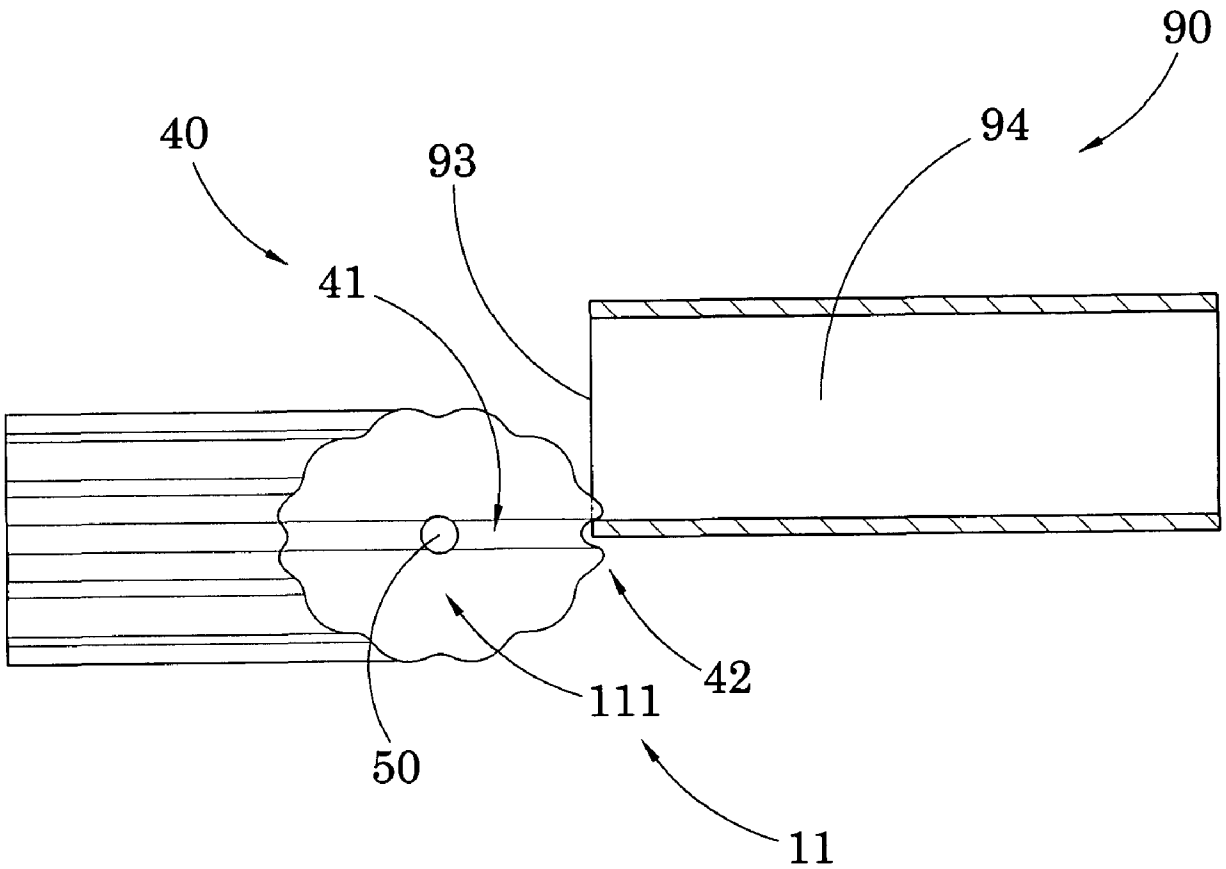
Figure 7D:
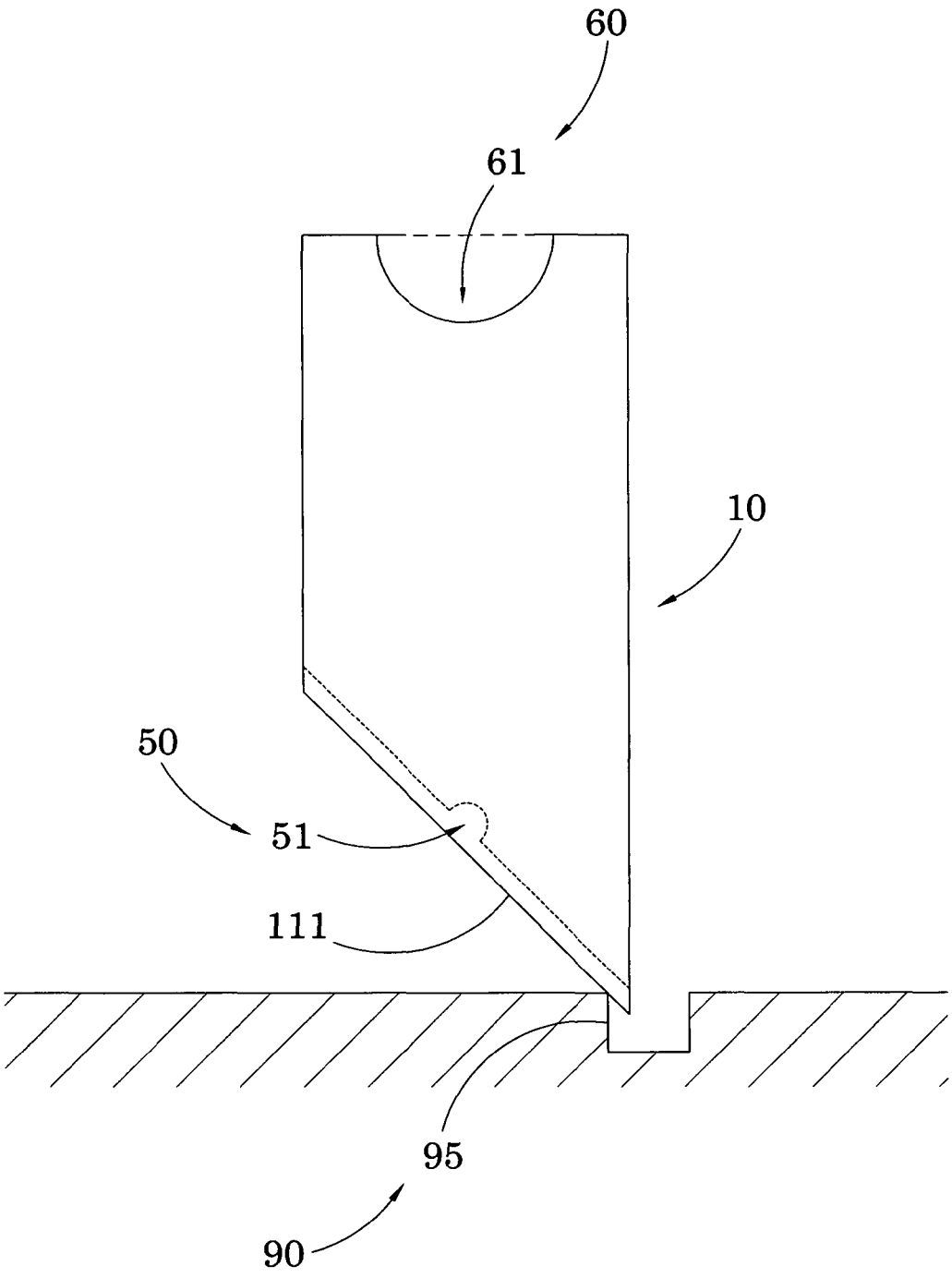

In the FIG. 7D, an application of a groove edge 95 of the workpiece 90 being abraded by the slanted sanding surface 111 is illustrated. The slanted sanding surface 111 having a narrowing tapered end portion adjacent to the tapered sanding notch 42 is able to reach to a relatively narrower groove of workpiece 90 for abrading the groove edge 95 thereof by the slanted sanding surface 111 at the first side 11.

The sanding arrangement further contains a sanding cavity 50 indentedly formed at the slanted sanding surface 111 at a center thereof along the sanding passage 40, wherein the sanding cavity 50 has a conic sanding surface 51 indently formed at the center of the slanted sanding surface 111 and integrally extended from the curved sanding surface 41 of the sanding passage 40. Accordingly, the depth of the sanding cavity 50 is larger than the depth of the sanding passage 40.

Figure 6:
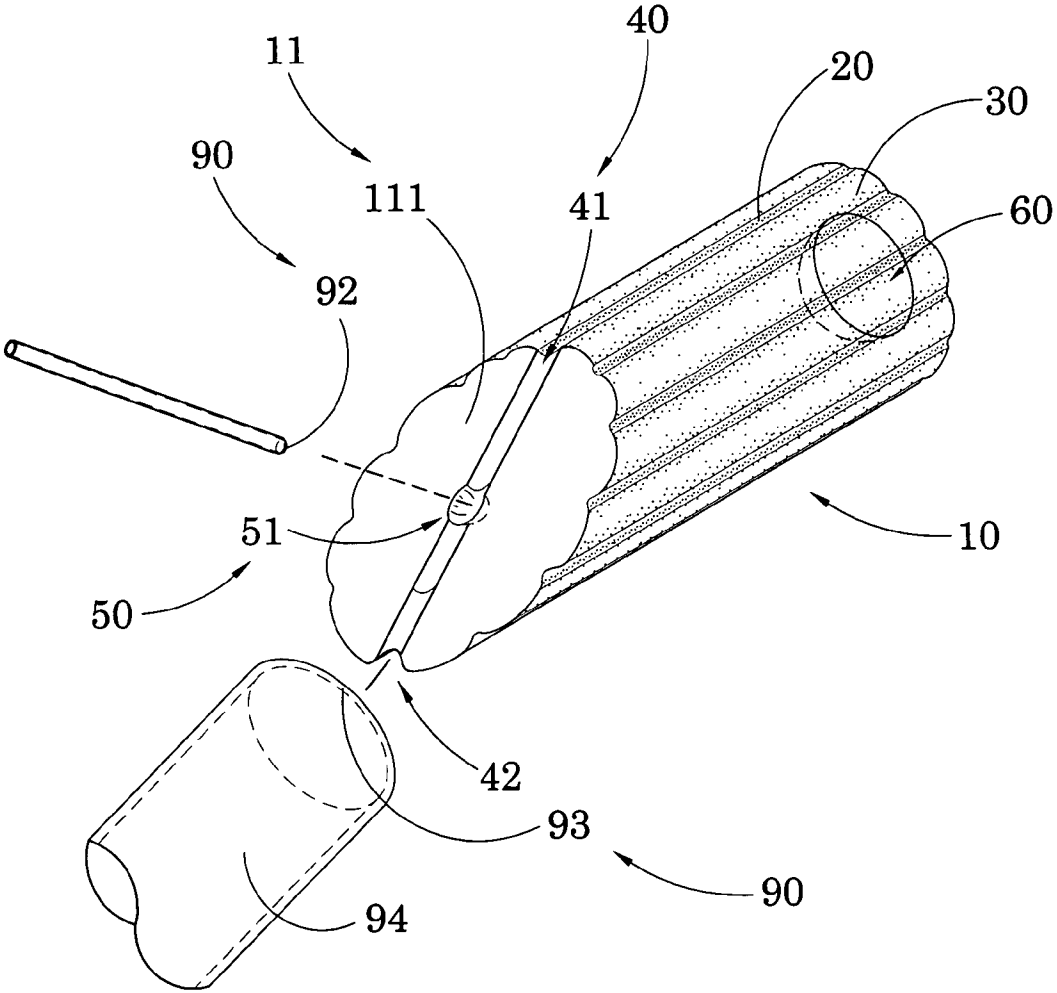
FIG. 6 illustrates the sanding application of the workpiece according to the above preferred embodiment of the present invention.

The conic sanding surface 51 of the sanding cavity 50 provides a cavity sanding contour to sand the workpiece 90 having a tapered end 92, as shown in FIG. 6 and FIG. 7B, in a circular sanding motion. In other words, the tapered end 92 of the workpiece 90 can be abraded at the conic sanding surface 51 of the sanding cavity 50. In addition, the sanding cavity 50 can used as a residual collection cavity for collecting the residual material of the workpiece 90 when the workpiece 90 is sanded via the sanding passage 40.

It is worth to mention that the residual material from the workpiece 90 may decrease the frictional force between the curved sanding surface 41 and the surface of the workpiece 90, so that abrading the surface of workpiece 90 via the sanding tool may not be efficiently operated. The sanding passage 40 is able to minimize the amount of the residual material of the workpiece 90 being sandwiched between the curved sanding surface 41 and the surface of the workpiece 90, so as to enhance the effectiveness and efficiency of the abrading the surface of the workpiece 90 via the sanding tool. Likewise, when the workpiece 90 is sanded by the slanted sanding surface 111, the sanding passage 40 will also collect the residual material of the workpiece 90 to enhance the efficiency of the sanding tool.

The sanding arrangement further contains a sanding chamber 60 indently formed at the second side 12 of the tool body 10, wherein the sanding chamber 60 has a spherical sanding surface 61 indently formed at a center of the second side 12 of the tool body 10 and coaxially aligned with the sanding cavity 50 at the first side 11 of the tool body 10. In particularly, the size of the sanding chamber 60 is larger than the size of the sanding cavity 50, wherein the depth of the sanding cavity 50 is smaller than the depth of the sanding chamber 60.

Accordingly, the sanding chamber 60 is adapted to be used for abrading the surface of the workpiece 90 having different shapes thereof in a circular sanding motion. For instance, the sanding chamber 60 is able to finish the outer peripheral edge of the opening of the tube 94 of the workpiece 90 as best shown in FIG. 7A.

According to the preferred embodiment, all the sanding surfaces, which are the concave-sanding surface 21 of the sanding grooves 20, the convex-sanding surface 31 of the sanding elements 30, the slanted sanding surface 111, the curved sanding surface 41 of the sanding passage 40, the tapered sanding notch 42, the conic sanding surface 51 of the sanding cavity 50, and the spherical sanding surface 61 of the sanding chamber 60, provides various sizes and orientations to abrade the workpiece 90. All the sanding surfaces have a predetermined abrading index, so that a small amount of material of the surface of the workpiece 90, such as the surface of the sharp edge of the workpiece 90, is able to be removed in order to smooth the surface thereof.

Accordingly, the tool body 10 is made of abrasive material that the first side 11, the second side 12, and the circumferential side 13 of the tool body 10 have the same grit size of abrasive particle. In other words, all the sanding surfaces may be integrally formed with the tool body 10, so that the sanding surfaces may depend on the material of the tool body 10, such as wood, steel, stone, or the likes.

Alternatively, the tool body 10 is coated with different abrasive layers at the first side 11, the second side 12, and the circumferential side 13 of the tool body 10 to provide different grit sizes of abrasive particles at various areas of the tool body 10. In other words, the sanding surfaces may be formed forming a layer of abrasive material thereon. For instance, the diamond sand of the abrasive material may be fixed on one of the sanding surfaces of the tool body 10 for providing a predetermined friction thereon to abrade the workpiece 90. The abrasive material may be fixed on the sanding surfaces of the tool body 10 via coating, spraying, or any other processes for permanently attaching thereto. It is worth to mention that the frictions of each of the sanding surfaces of the tool body 10 may be controlled via fixing different sized particles having corresponding diameters thereof onto the sanding surfaces, so that the abrasive material is able to control the smoothness or roughness of the targeted surfaces of the workpiece 90.

As mentioned above, the sanding surfaces of the tool body 10 may formed via forming a plurality of patterns or configurations thereon to increase the friction of the frictional surface. For examples, a straight sanding line pattern, a slanted sanding line pattern, or a crossed sanding line pattern can be selectively provided at different sanding surfaces of the tool body 10. It is appreciated that different grit sizes of abrasive particles can be provided at different sanding grooves 20 as well, such that by sanding along different sanding grooves 20 orderly, the workpiece 90 can be sanded from rough to fine level without switching between different tools. In other words, the user is able to use one single sanding tool of the present invention to complete the sanding operation.

In other words, the sanding surfaces of the tool body 10 may have variety of frictions or roughness to form variety of sanding areas, wherein sanding areas have different frictions thereon via providing different frictions of the sanding surfaces of the tool body 10, in such a manner that the one single sanding tool of the present invention is able to provide not two or more frictions of the sanding surfaces for selectively abrading the workpiece. For instances, the sanding grooves 20 may have two different frictions alternatively provided on the outer circumferential side 13 of the tool body 10 to form the alternative sanding areas; some of the concave-sanding surface 21 of the sanding grooves 20 located on half of the circumferential side 13 of the tool body 10 may have smoother frictional surfaces thereon, while the other concave-sanding surface 21 of the sanding grooves 20 located on another half of the circumferential side 13 of the tool body 10 may have relatively rougher frictional surfaces thereon, so as to form two sanding areas on the outer circumferential side 13. Therefore, the user is able to selectively abrade the surface of the workpiece 90 to form different smoothness at the surface of the workpiece 90.

Accordingly, the sanding tool of the present invention realizes evenly applying the abrading force to the workpiece 90 and combining multi-functions in one single sanding tool for smoothing variety parts of the workpiece surfaces. The geometric shape of the tool body 10 including the slanted sanding surface 111 enhances the ergonomic feature of the sanding tool, so that the tool body 10 is able to be held by a hand of the user to operate the abrading process, so as to evenly apply the abrading force to perfectly finish the workpiece.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sanding tool for a workpiece, comprising:

an elongated hand-held tool body having a first side, an opposed second side, and an outer circumferential side extended from said first side to said second side; and a sanding arrangement, comprising:

a slanted sanding surface provided at said first side of said tool body for enhancing a contact surface area to sand said workpiece at said slanted sanding surface;

a sanding passage indentedly formed at said slanted sanding surface along a major axis thereof, wherein said sanding passage has a curved sanding surface indentedly at said slanted sanding surface of said tool body; and a sanding cavity indentedly formed at said slanted sanding surface at a center thereof along said sanding passage.

2. The sanding tool, as recited in claim 1, wherein said sanding cavity has a conic sanding surface indentedly formed at said center of said slanted sanding surface.

3. The sanding tool, as recited in claim 2, wherein said sanding arrangement further contains a sanding chamber indentedly formed at said second side of said tool body, wherein said sanding chamber has a spherical sanding surface indentedly formed at a center of said second side of said tool body.

4. A sanding tool for a workpiece, comprising:

an elongated hand-held tool body having a first side, an opposed second side, and an outer circumferential side extended from said first side to said second side, wherein said first side of said tool body is a slanted sanding surface for enhancing a contact surface area to sand said workpiece at said slanted sanding surface; and a sanding arrangement which contains a plurality of elongated sanding grooves spacedly provided at said outer circumferential side of said tool body and longitudinally extended from said first side to said second side, wherein each of said sanding grooves has two open ends formed at said first and second sides of said tool body respectively and a concave-sanding surface defining two arc-sanding faces therealong, such that when said tool body is held for contacting a rough portion of said workpiece with one of said arc-sanding faces, said tool body is adapted to impart reciprocating movement for sanding said rough portion of said workpiece along said respective sanding groove.

5. The sanding tool, as recited in claim 4, wherein said sanding arrangement further comprises a plurality of convex sanding elements alternating with said sanding grooves and longitudinally extended from said first side of said tool body to said second side thereof, wherein each of said convex sanding elements has a convex-sanding surface integrally extended between said concave-sanding surfaces of said two neighboring sanding grooves.

6. The sanding tool, as recited in claim 4, wherein said sanding arrangement further contains a sanding passage indentedly formed at said slanted sanding surface along a major axis thereof, wherein said sanding passage has a curved sanding surface indented at said slanted sanding surface of said tool body and two opened ends alignedly extending with said opened ends of said two corresponding sanding grooves at said outer circumferential side of said tool body.

7. The sanding tool, as recited in claim 5, wherein said sanding arrangement further contains a sanding passage indentedly formed at said slanted sanding surface along a major axis thereof, wherein said sanding passage has a curved sanding surface indented at said slanted sanding surface of said tool body and two opened ends alignedly extending with said opened ends of said two corresponding sanding grooves at said outer circumferential side of said tool body.

8. The sanding tool, as recited in claim 6, wherein said sanding arrangement further contains a sanding cavity indentedly formed at said slanted sanding surface at a center thereof along said sanding passage.

9. The sanding tool, as recited in claim 7, wherein said sanding arrangement further contains a sanding cavity indentedly formed at said slanted sanding surface at a center thereof along said sanding passage.

10. The sanding tool, as recited in claim 8, wherein said sanding cavity has a conic sanding surface indentedly formed at said center of said slanted sanding surface.

11. The sanding tool, as recited in claim 9, wherein said sanding cavity has a conic sanding surface indentedly formed at said center of said slanted sanding surface.

12. The sanding tool, as recited in claim 5, wherein said sanding arrangement further contains a sanding chamber indentedly formed at said second side of said tool body, wherein said sanding chamber has a spherical sanding surface indentedly formed at a center of said second side of said tool body.

13. The sanding tool, as recited in claim 11, wherein said sanding arrangement further contains a sanding chamber indentedly formed at said second side of said tool body, wherein said sanding chamber has a spherical sanding surface indentedly formed at a center of said second side of said tool body.

14. The sanding tool, as recited in claim 13, wherein said tool body is made of abrasive material that said first side, said second side, and said outer circumferential side of said tool body have the same grit size of abrasive particle.

15. The sanding tool, as recited in claim 14, wherein said tool body is coated with different abrasive layers at said first side, said second side, and said outer circumferential side of said tool body to provide different grit sizes of abrasive particles at various areas of said tool body.

16. A sanding tool for a workpiece, comprising:

an elongated hand-held tool body having a first side, an opposed second side, and an outer circumferential side extended from said first side to said second side; and a sanding arrangement which contains a plurality of elongated sanding grooves spacedly provided at said outer circumferential side of said tool body and longitudinally extended from said first side to said second side, wherein each of said sanding grooves has two open ends formed at said first and second sides of said tool body respectively and a concave-sanding surface defining two arc-sanding faces therealong, such that when said tool body is held for contacting a rough portion of said workpiece with one of said arc-sanding faces, said tool body is adapted to impart reciprocating movement for sanding said rough portion of said workpiece along said respective sanding groove, wherein said sanding arrangement further contains a sanding chamber indentedly formed at said second side of said tool body, wherein said sanding chamber has a spherical sanding surface indentedly formed at a center of said second side of said tool body.

* * * * *